US010364522B2

(12) United States Patent
Park et al.

(10) Patent No.: US 10,364,522 B2
(45) Date of Patent: Jul. 30, 2019

(54) WASHING MACHINE AND METHOD OF CONTROLLING THE SAME

(71) Applicant: LG ELECTRONICS INC., Seoul (KR)

(72) Inventors: Youngbae Park, Seoul (KR); Changsik Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 17 days.

(21) Appl. No.: 15/551,425

(22) PCT Filed: Feb. 17, 2016

(86) PCT No.: PCT/KR2016/001593
§ 371 (c)(1),
(2) Date: Aug. 16, 2017

(87) PCT Pub. No.: WO2016/133358
PCT Pub. Date: Aug. 25, 2016

(65) Prior Publication Data

US 2018/0030635 A1 Feb. 1, 2018

(30) Foreign Application Priority Data

Feb. 17, 2015 (KR) ..... 10-2015-0024409

(51) Int. Cl.
*D06F 33/02* (2006.01)
*D06F 39/00* (2006.01)
(Continued)

(52) U.S. Cl.
CPC ..... *D06F 33/02* (2013.01); *D06F 13/00* (2013.01); *D06F 35/00* (2013.01); *D06F 35/006* (2013.01); *D06F 37/12* (2013.01); *D06F 37/24* (2013.01); *D06F 37/304* (2013.01); *D06F 37/36* (2013.01); *D06F 37/40* (2013.01); *D06F 39/00* (2013.01); *D06F 39/005* (2013.01); *D06F 39/02* (2013.01); *D06F 39/085* (2013.01); *D06F 39/087* (2013.01); *D06F 39/088* (2013.01); *D06F 39/10* (2013.01); *D06F 23/04* (2013.01);
(Continued)

(58) Field of Classification Search
CPC ..... D06F 33/02
See application file for complete search history.

(56) References Cited

FOREIGN PATENT DOCUMENTS

JP 2004-141344 5/2004
JP 2014-133182 7/2014
(Continued)

OTHER PUBLICATIONS

Yamamoto et al., Jul. 2014, JP2014133182, English machine translation (Year: 2014).*
(Continued)

*Primary Examiner* — Jason Y Ko
(74) *Attorney, Agent, or Firm* — Ked & Associates, LLP

(57) ABSTRACT

A washing machine and a method of controlling the washing machine is provided. The method may include supplying water to a tub, treating laundry by rotating a basket provided in the tub, and discharging water in the tub, wherein discharging the water includes rotating the basket during the water discharge so as to wash a filter, which may be provided between the tub and an opening formed in a lower portion of the basket, using a water stream.

15 Claims, 6 Drawing Sheets

(51) Int. Cl.

| | |
|---|---|
| ***D06F 35/00*** | (2006.01) |
| ***D06F 39/08*** | (2006.01) |
| ***D06F 39/10*** | (2006.01) |
| ***D06F 37/30*** | (2006.01) |
| ***D06F 13/00*** | (2006.01) |
| ***D06F 37/12*** | (2006.01) |
| ***D06F 37/24*** | (2006.01) |
| ***D06F 37/36*** | (2006.01) |
| ***D06F 37/40*** | (2006.01) |
| ***D06F 39/02*** | (2006.01) |
| *D06F 23/04* | (2006.01) |

(52) U.S. Cl.
CPC ..... *D06F 39/083* (2013.01); *D06F 2202/085* (2013.01); *D06F 2204/065* (2013.01); *D06F 2204/084* (2013.01); *D06F 2204/086* (2013.01)

(56) References Cited

FOREIGN PATENT DOCUMENTS

| | | |
|---|---|---|
| KR | 10-1999-0041410 | 6/1999 |
| KR | 10-0645651 | 11/2006 |
| KR | 10-0933701 | 12/2009 |

OTHER PUBLICATIONS

International Search Report (Full English Text) and Written Opinion dated Jul. 11, 2016 issued in Application No. PCT/KR2016/001593.

* cited by examiner

[Fig. 1]
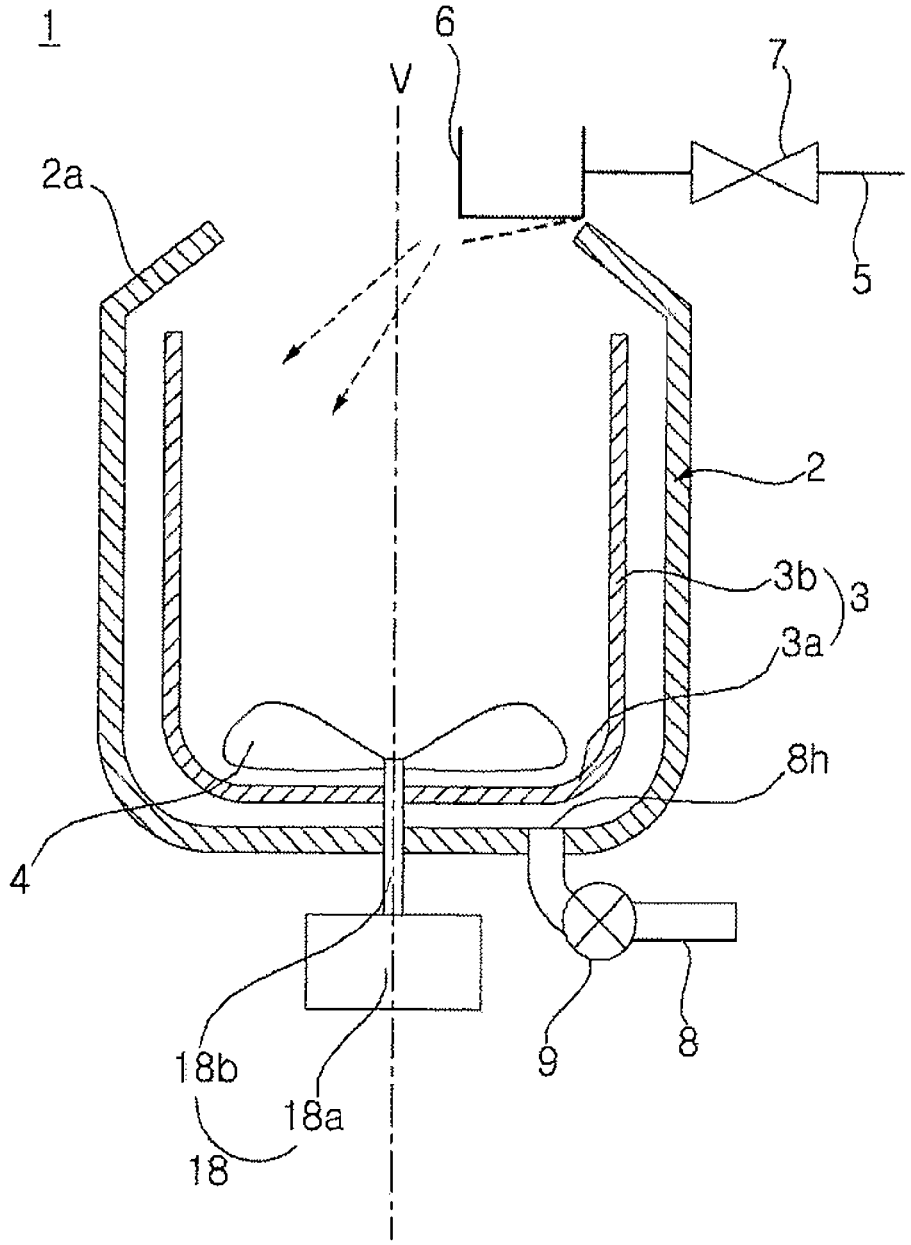

[Fig. 2]
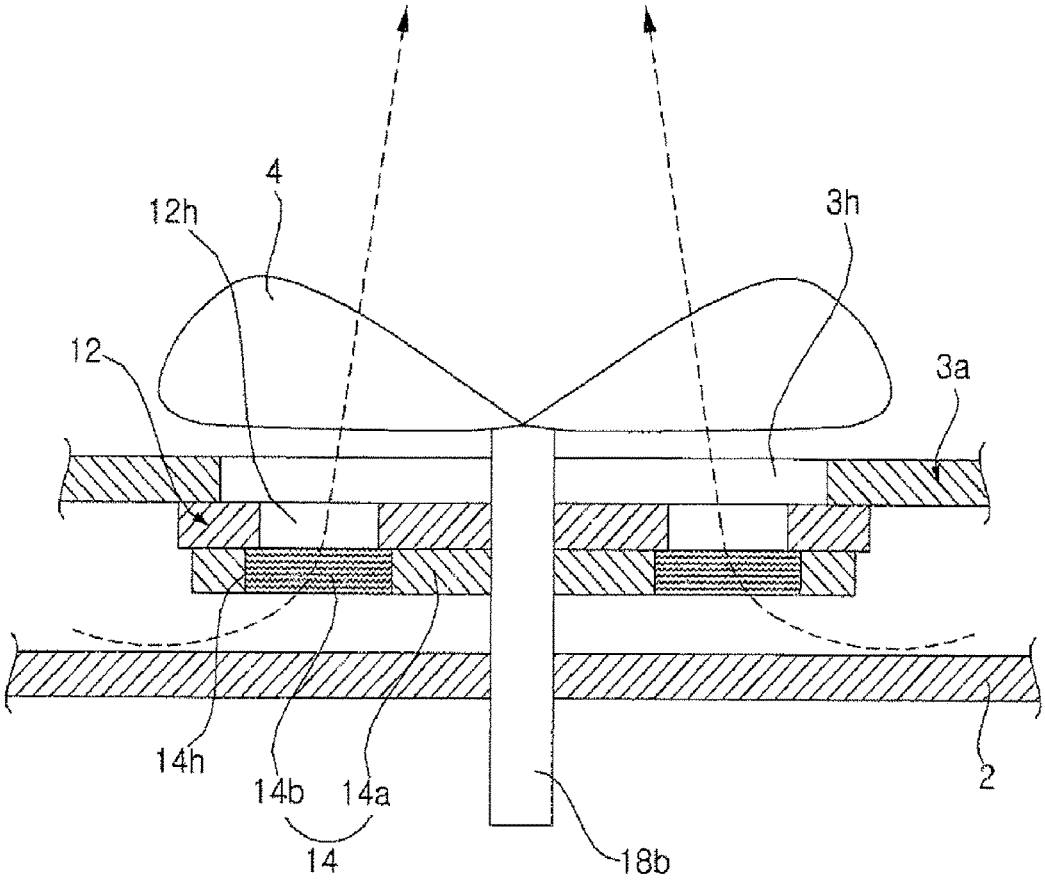

[Fig. 3]
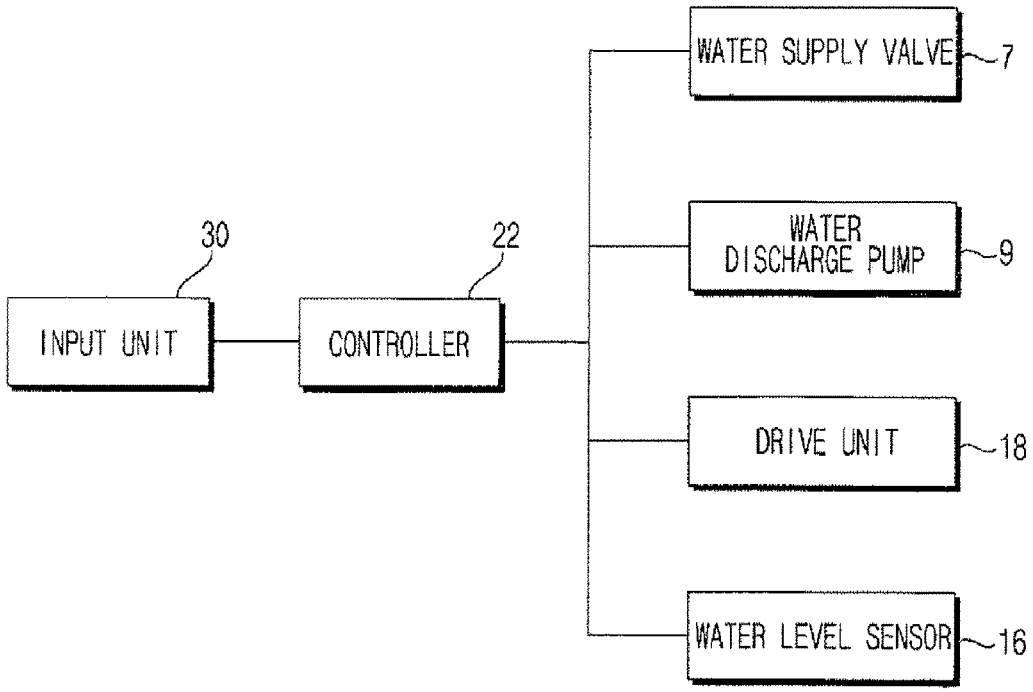

[Fig. 4]
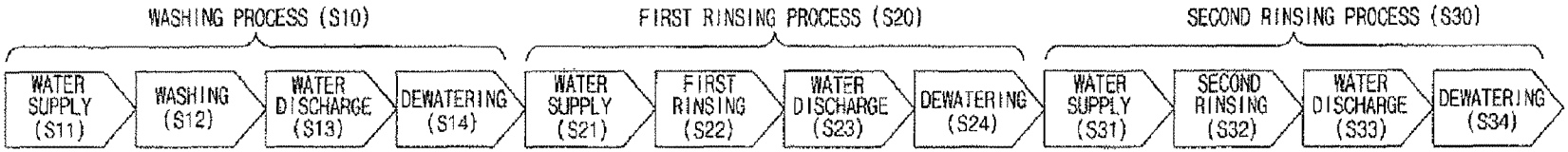

[Fig. 5]
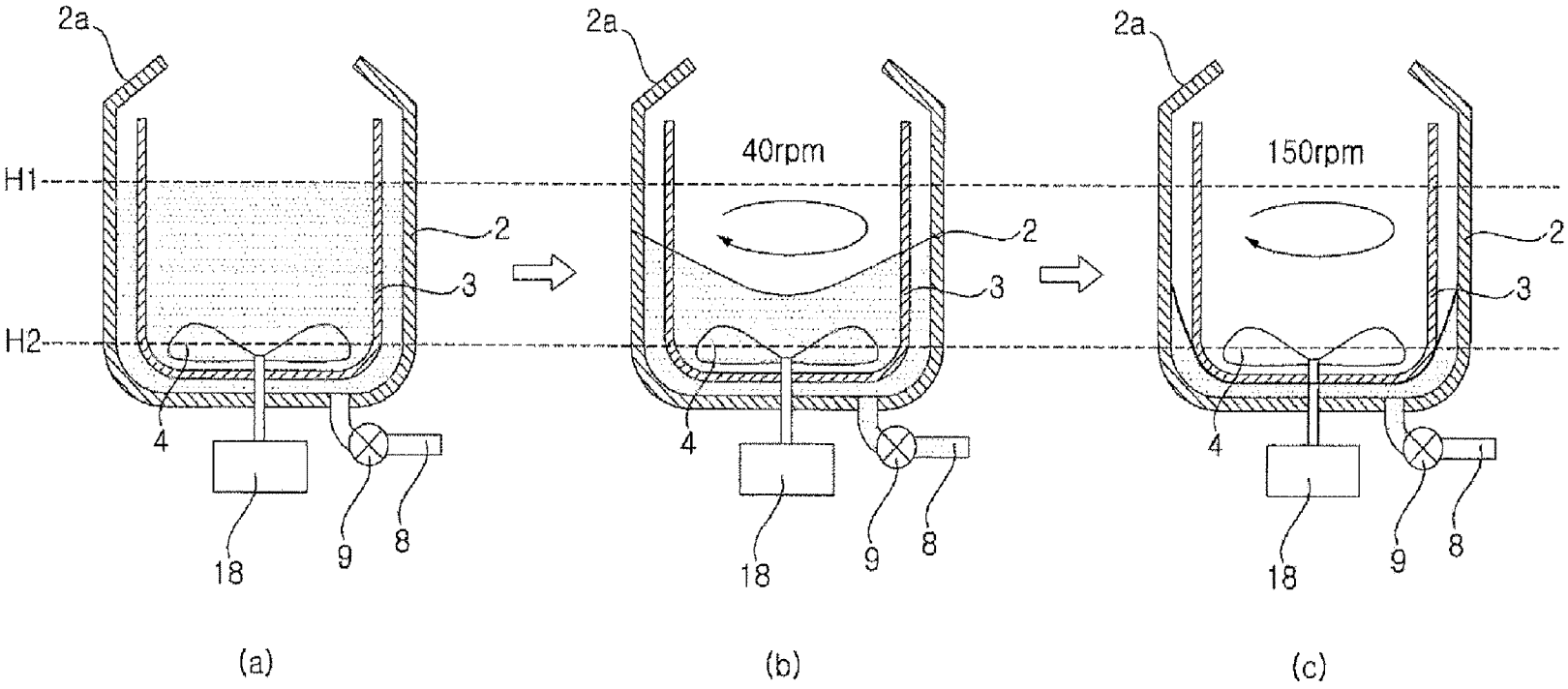

[Fig. 6]
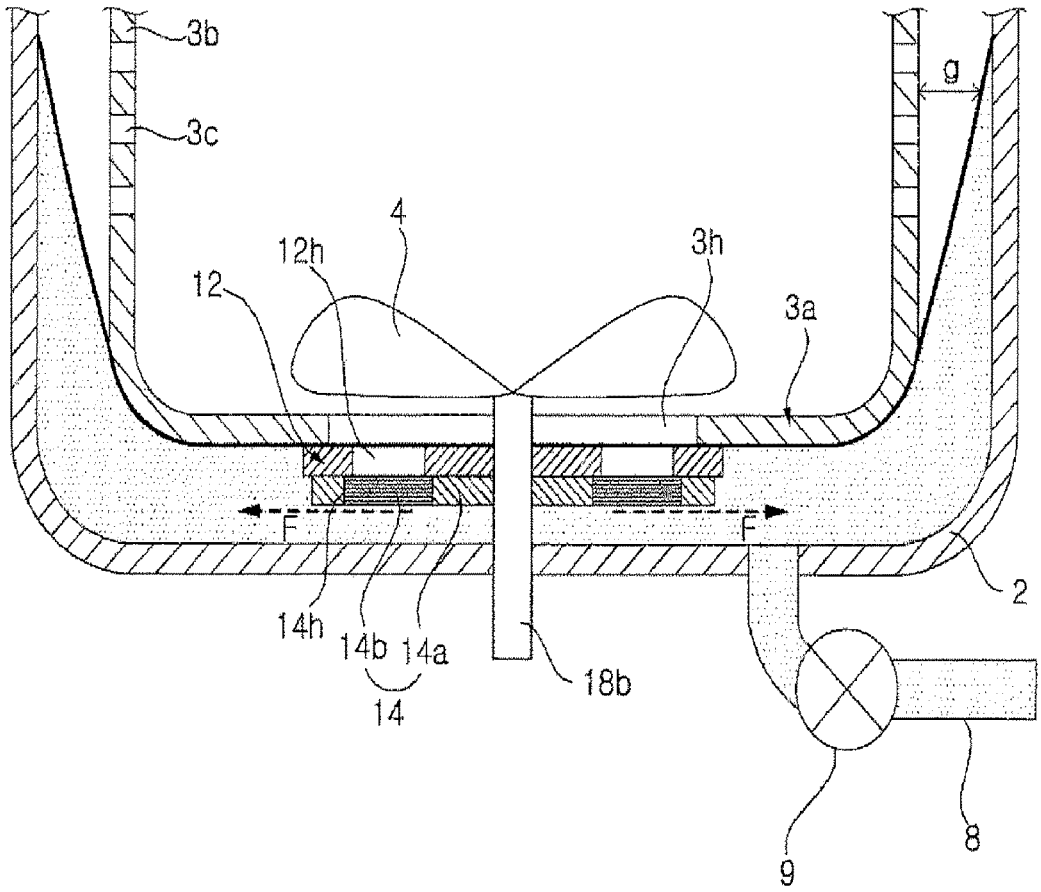

WASHING MACHINE AND METHOD OF CONTROLLING THE SAME

CROSS-REFERENCE TO RELATED PATENT APPLICATIONS

This application is a U.S. National Stage Application under 35 U.S.C. § 371 of PCT Application No. PCT/KR2016/001593, filed Feb. 17, 2016, which claims priority to Korean Patent Application No. 10-2015-0024409, filed Feb. 17, 2015, whose entire disclosures are hereby incorporated by reference.

TECHNICAL FIELD

Embodiments relate to a washing machine and a method of controlling the washing machine.

BACKGROUND ART

A washing machine washes laundry using the surfactant action of detergent, a water stream generated via rotation of, for example, a washing tub or a washing blade, and shocks applied by the washing blade. The washing machine may perform washing, rinsing and/or dehydration processes to remove contaminants in laundry or clothes through an interaction of water and detergent. A washing machine may include a casing defining an appearance of the washing machine, an imperforated tub, which is provided in the casing in a suspended state, and a perforated basket or a drum, which is rotatably provided in the tub. Since the basket and the tub may become contaminated due to various causes, such as, e.g., scaling, slime, solidified detergent, with repeated use over a long time, periodically cleaning the tub and components provided in the tub, or tub washing, may remove the contamination sources.

Although a washing machine may provide an additional tub washing operation, which may be executed when selected by a user, it may not be easy to determine a time when the tub washing may be necessary. Furthermore, although the tub washing operation may be unrelated to an actual washing of laundry, execution of the tub washing course may consume considerable amounts of time, water and electricity, thereby making it difficult to utilize the tub washing operation. Consequently, laundry may be contaminated by pollutants from a basket or a tub, and such contamination may be dissatisfactory to users.

DISCLOSURE OF INVENTION

Technical Problem

The present disclosure discloses a washing machine and a method of controlling the washing machine capable of cleaning a filter adapted to filter a water stream introduced into a basket from a tub through an opening formed in the bottom of the basket, and a washing machine and a method of controlling the washing machine capable of creating a powerful water stream that washes a surface of a filter during a discharge of water in a washing process or a rinsing process.

The present disclosure provides a washing machine and a method of controlling the same capable of automatically cleaning a filter in a washing process or a rinsing process without an additional tub washing operation, and a washing machine and a method of controlling the same with minimal additional time or labor required to clean a filter by cleaning the filter while water is discharged. The present disclosure also provides a washing machine and a method of controlling the same capable of intense cleaning of components, e.g., a pulsator, a filter and a hub, provided at a lower region in a basket, during operation of the washing machine.

Solution to Problem

In accordance with embodiments disclosed herein, a washing machine may include a tub configured to contain water, a basket provided in the tub so as to be rotatable about a vertical axis, the basket having an opening formed in a lower portion thereof so as to allow the basket to communicate with the tub, and a plurality of through holes formed in a side wall thereof through which water flows laterally, a pulsator rotatably provided at a lower portion of the basket, a filter to filter water that flows from the tub to the basket through the opening during a rotation of the pulsator, a water supply valve to supply water to the tub, a water discharge pump to discharge water from the tub, a drive unit or drive mechanism to drive at least one of the pulsator and the basket, and a controller that controls the water supply valve to be opened for the supply of water, controls the drive unit to rotate at least one of the pulsator and the basket so as to treat laundry introduced into the drum, controls the water discharge pump to discharge water used in the treatment of the laundry, and controls the drive unit to rotate the basket while the water is discharged by the water discharge pump.

The controller may control the basket to be rotated at a first rotational speed while water is discharged, and may control the basket to be increased to a second rotational speed when a level of water in the tub is lowered to a predetermined level while the basket rotates at the first rotational speed. The basket may include a drum, which may extend around the vertical axis so as to constitute the side wall, and a base, which may be coupled to the lower end of the drum so as to constitute the lower portion, with the opening formed in a center of the base. The second rotational speed may be set such that water may be raised between the drum and the tub and may press to the tub due to a centrifugal force caused by the rotation of the basket, whereby a surface of water where the water presses to the tub may be separated from the drum.

The first rotational speed may be set such that the water raised between the drum and the tub by the rotation of the basket is not raised beyond an upper end of the basket. The predetermined level may be set such that the pulsator is not completely immersed in water. The predetermined level may be set such that at least the filter is completely immersed in the water.

The controller may execute a first process, which may include the water supply, the treatment of laundry and the water discharge, and may execute, after the first process, a second process, which may include the water supply, the treatment of laundry and the water discharge, wherein, in the water discharge of the second process, the basket rotates in a direction opposite to a direction in which the basket rotated in the first process. The tub may include a water discharge port positioned or provided under the filter. The washing machine may further include a hub coupled to the basket and rotated by the drive unit, wherein the filter is provided under the hub.

In accordance with the present disclosure, there is provided a method of controlling a washing machine, including supplying water to a tub, treating laundry by rotating a basket provided in the tub, and discharging water in the tub, wherein discharging the water may include rotating the basket during water discharge so as to wash a filter, which is provided between the tub and an opening formed in the lower portion of the basket, using a water stream.

Rotating the basket may include rotating the basket at a first speed, increasing the rotational speed of the basket from the first speed to a second speed, and rotating the basket at the second speed. The rotational speed of the basket may be increased when the level of water in the tub is lowered to a predetermined level. The second speed may be set such that water may be raised between the basket and the tub and may press to the tub due to centrifugal force caused by the rotation of the basket, whereby a surface of water where the water presses to the tub may be separated from the basket.

A first process may include supplying the water, treating the laundry, and discharging the water may be executed, and thereafter, a second process may include supplying the water, treating the laundry, and discharging the water, wherein, in discharging the water in the second process, the basket rotates in a direction opposite to a direction in which the basket rotates in the discharging the water of the first process.

Advantageous Effects of Invention

The washing mashing and the method of controlling the washing machine may clean a filter adapted to filter a water stream, which may be introduced into a basket from a tub through an opening formed in the bottom of the basket. The washing machine and the method of controlling the same may create a powerful water stream that washes a surface of a filter while water is discharged in a washing process or a rinsing process, thereby automatically cleaning the filter in the washing process or the rinsing process without an additional tub washing operation, and eliminating additional time and labor required to clean the filter. In addition, the washing machine and method of controlling the same may intensively clean components, such as a pulsator, a filter and a hub, provided in the lower region of a basket.

BRIEF DESCRIPTION OF DRAWINGS

The embodiments will be described in detail with reference to the following drawings in which like reference numerals refer to like elements wherein:

FIG. 1 is a cross-sectional view schematically showing a washing machine according to an embodiment;

FIG. 2 is a cross-sectional view showing a portion of the washing machine shown in FIG. 1;

FIG. 3 is a block diagram showing relationships between components of the washing machine according to the embodiment;

FIG. 4 is a flowchart showing a method of controlling the washing machine according to an embodiment;

FIGS. 5(*a*)-5(*c*) are views sequentially showing water discharge steps sequentially water discharge steps S13, S23 and S33 of the washing machine shown in FIG. 4; and FIG. 6 is a cross-sectional view showing a level of water in a tub shown in FIG. 5(*c*).

BEST MODE FOR CARRYING OUT THE INVENTION

The advantages, features and methods for achieving those of embodiments may become apparent upon referring to embodiments described later in detail together with the attached drawings. However, the embodiments are not limited to the embodiments disclosed hereinafter, but may be embodied in different modes. The embodiments are provided for completeness of disclosure and informing the scope thereof to persons skilled in this field of art. The same reference numbers may refer to the same elements throughout the specification.

Referring to FIGS. 1 to 3, the washing machine 1 may include a tub 2 configured to contain water, a basket or a drum 3 rotatably provided in the tub 2 so as to contain laundry, and a pulsator 4 rotatably provided at a bottom of the basket 3.

The tub 2 may be provided within a casing defining an appearance of the washing machine 1, and may be suspended from the casing by means of a suspension so as to absorb vibrations generated by the rotation of the basket 3. The basket 3 may rotate about a vertical axis V, and the tub 2 may be configured as a cylinder, which may be open at an upper end so as to allow clothes to be introduced thereinto from above. The tub 2 may be provided with an annular cover 2*a* that guides a water stream, which may become raised above an upper end of the basket 3 along a channel between the tub 2 and the basket 3 while the basket 3 rotates at an appropriate speed, into the basket 3.

The basket 3 may be rotatably provided in the tub 2, and may be provided in or at a bottom thereof with an opening 3*h* so as to allow the basket 3 to communicate with the tub 2. The basket 3 is also provided in the side wall thereof with a plurality of through holes 3*c* (see FIG. 6) through which laterally flowing water may pass. For example, the basket 3 may include a side wall 3*b*, which may extend around the vertical axis V, and a base or a bottom 3*a*, which may be coupled to a lower end of the drum 3*b* and may have the opening 3*h* formed in the center thereof. The side wall 3*b* and the base 3*a* may be a single piece, but may also be separate pieces, which may be coupled to each other. The pulsator 4 may have a plurality of through holes formed therein such that water introduced into the tub 2 through the opening 3*h* may flow into the basket 3 through the plurality of through holes formed in the pulsator 4. A hub 12 may be coupled to the basket 3 around the opening 3*a*.

The casing may be provided with a control panel, which may include an input unit or an input interface 30 to enable various settings, for example, selection of operations and input of time, to be selected and input by a user to operate the washing machine 1, and a display to display an operational state of the washing machine 1, for example, a state of progress of a operation and a remaining time. The input unit 30 may be configured to allow settings for a tub washing operation to be input by a user. Based on settings input through the input unit 30, the tub washing may be performed, a tub washing in progress may be stopped, or other various settings may be changed.

The input unit 30 may allow settings for a washing cycle to be input by a user. The washing cycle may be a series of processes that remove pollutants from laundry through washing, rinsing and/or dewatering processes. One washing cycle may include selection of a certain operation through the input unit 30, and washing, rinsing and/or dewatering processes executed in accordance with an algorithm that has been previously determined based on the selected operation. A controller 22 may include a microprocessor, which may control operation of various devices and/or components of the washing machine 1.

A drive unit or drive mechanism 18 may include a motor 18*a* for generating a rotational force, and a clutch to engage the rotating shaft 18*b* of the motor 18*a* with the hub 12 or disengage the rotating shaft 18*b* from the hub 12. The rotating shaft 18*b* of the motor 18*a* may be connected to the pulsator 4. The basket 3 rotates with the pulsator 4 when the rotating shaft 18*b* is engaged with the hub 12, whereas only the pulsator 4 rotates while the basket 3 is stopped when the rotating shaft 18*b* is disengaged from the hub 12. A state in which the basket 3 rotates with the pulsator 4 may be referred to as a "basket rotating mode", and a state in which only the pulsator 4 rotates while the basket 3 is stopped may be referred to as an "agitation mode". The pulsator 4 may be alternately rotated in opposite directions in the agitation mode. Although the pulsator 4 may be described as being rotated in opposite directions in the agitation mode, the embodiments are not limited thereto. The agitation mode may also be performed in such a manner as to repeat rotation and braking of the pulsator 4 while the pulsator 4 rotates only in one direction.

The speed of the motor 18*a* may be controlled. For example, although the motor 18*a* may be a brushless DC (BLDC) motor, the embodiments are not limited thereto. As technology for controlling a rotational speed of the basket 3 or the pulsator 4 using a motor such as a BLDC motor, the speed of which is controllable, is already known in the field of washing machines, a detailed description thereof has been omitted.

The pulsator 4 may include a plurality of ribs, which may extend radially from a center thereof to generate a water stream. By designing the plurality of ribs to have an appropriate shape, a water stream that flows upward during rotation of the pulsator 4 may be created in the basket 3. The hub 12 may have a plurality of through holes 12*h*, which may be circumferentially arranged around the rotating shaft 18*b*. When the basket 3 or the pulsator 4 rotates, a water stream (shown in FIG. 2 as a dotted line arrow) that flows into the basket 3 from the tub 2 through the through holes 12*h* may be created.

The washing machine may be provided with a filter 14 that filters pollutants contained in the water stream passing through the through holes 12*h*. The filter 14 may include a filter frame 14*a* having filter holes 14*h*, which may be formed in locations that correspond to the through holes 12*h*, and filter meshes 14*b*, which may be secured to the filter frame 14*a* so as to filter pollutants contained in the water stream passing through the filter holes 14*h*. Although the filter 14 may be coupled to a lower surface of the hub 12, embodiments are not limited thereto.

The washing machine 1 may further include a water supply unit or device to supply water to the inside of the tub 2, and a water discharge unit or device to discharge the water in the tub 2. The water supply unit may include a water supply valve 7 to open or close a water supply channel 5 connected to a water source, for example, a faucet. The water supply channel 5 may be provided with a detergent box 6 such that the water supplied through the water supply channel 5 may be supplied to an inside of the tub 2 or the basket 3 through the detergent box 6 when the water supply valve 7 is opened. The washing machine may be provided with a nozzle to directly inject water into the basket 3 without causing the water to pass through the detergent box 6. The water discharge unit may include a water discharge pump 9 provided at the water discharge channel 8 so as to discharge the water in the tub 2 to the outside. The water discharge unit may further include a water discharge valve to open or close the water discharge channel 8. The water discharge pump 9 may be operated while the water discharge valve is open.

Referring to FIG. 4, a washing cycle may be performed in accordance with a setting input through the input unit 30. The washing cycle may include at least one process. The process may include water supply steps S11, S21 and S31 of supplying water to the inside of the tub 2, washing steps S12, S22 and S32 of washing laundry using the supplied water, and water discharge steps S13, S23 and S33 of discharging the water that has been used in washing of the laundry from the tub 2. The method may further include dewatering steps S14, S24 and S34, which may be executed after the water discharge steps.

The method of controlling the washing machine according to the embodiment may include a washing process S10, a first rinsing process S20 and a second rinsing process S30. A number of times the washing process or the rinsing process may be executed may be varied. The washing process S10, which may be a process of removing pollutants from clothes using detergent, may include a water supply step S11, a washing step S12, a water discharge step S13, and a dewatering step S14.

The water supply step S11 of supplying water to the inside of the tub 2 may be executed such that the controller 22 controls the water supply valve 7 to be opened so as to allow water to be supplied to the detergent box 6 through the water supply channel 5. The detergent contained in the detergent box 6 may be supplied to the tub 2 or the basket 3 together with water. An amount of water supplied in the water supply step S11 may be set based on an amount of laundry or items introduced into the basket 3. The washing machine may be able to detect the amount of laundry or items. Since methods or apparatuses to detect the amount of laundry or items are well known in the art, a detailed description thereof has been omitted.

When the amount of water to be supplied is determined based on the amount of laundry, the controller 22 may control the water supply valve 7 to allow the determined amount of water to be supplied. The washing machine may further include a detector to detect the amount of water that is supplied during the supply of water. The detector to detect the amount of water that is supplied may include a water level sensor 16 (see FIG. 3) to detect the level of water in the tub 2. The controller 22 may control the water supply valve 7 based on a first water level detected by the water level sensor 16 so as to supply water to a second water level, which may be determined based on the amount of laundry.

The washing step S12 is a step of rotating at least one of the pulsator 4 and the basket 3 in accordance with a predetermined pattern while the tub 2 is filled with the water and the detergent supplied in the water supply step S11, thereby removing pollutants from the laundry. A water stream may be created by rotation of the basket 3 and/or the pulsator 4. For example, as shown in FIG. 2, a water stream directed upward may be created in the basket 3 by rotation of the pulsator 4. The water stream, which may be raised in the basket 2, may be discharged into the tub 2 through the through holes 3*c* formed in the side wall of the basket 3, and may be introduced into the basket 3 through the opening 3*h* in the base 3*a*, thereby forming a circulating water stream.

The pulsator 4 may separate pollutants from laundry by applying mechanical force, which may be caused by friction or impact during rotation, to the laundry. In the operation of execution of the washing step, lint, depending on materials of the laundry, may be separated from the laundry and may be suspended in water. Since the circulating water stream created by rotation of the pulsator 4 passes through the filter 14 from below, the pollutants separated from laundry may collect on the lower surface of the filter meshes 14*b*.

The water discharge step S13 may be executed after completion of the washing step S12, and the controller 22 may control the water discharge pump 9 to discharge water from the tub 2 and also may control the water discharge valve to be opened. Since the water passes through the filter 14 from above during the water discharge step, pollutants collected at the filter mesh 14*b* may be discharged into the water discharge channel 8 through a water discharge port 8*h* together with the water.

In the water discharge step S13, the controller 22 may control the drive unit 18 to rotate the basket 3 during the water discharge step or basket rotation mode, and the basket may be continuously rotated in one direction. Although the basket 3 may be rotated during an entirety of the water discharge step, embodiments are not limited thereto. As shown in FIG. 6, a water stream F (a water flow) directed outward in a radial direction from the center of the basket 3 by rotation of the basket 3 may be created between the base 3*a* of the basket 3 and the tub 2, and pollutants may be separated from a surface of the filter 14 by the water stream F. Since cleaning of the filter 14 by the water stream F may occur during the water discharge step S13, the pollutants separated from the filter 14 may be discharged through the water discharge channel 8 together with the water. Accordingly, laundry may be prevented from being re-contaminated by the pollutants separated from the filter 14.

The basket 3 may be rotated during the execution of the water discharge step S13. Although the basket 3 may be rotated at a constant speed while the water discharge step is executed, the basket 3 may be rotated at a low speed in an initial stage of the water discharge step, and a rotational speed of the basket 3 may increase when the level of water in the tub 2 is lowered to a predetermined water level.

In FIGS. 5(*a*)-5(*c*), H1 indicates a level of water in the tub 2 when water discharge begins, and the level of water may be referred to as a washing level or a rinsing level depending on a process, and H2 indicates a set water level. In an initial stage of the water discharge, the basket 3 may be rotated at a first speed. When the water level is lowered to the set water level H2, the controller 22 may control the drive unit 18 to increase the rotational speed of the basket 3. When the rotational speed of the basket 3 reaches a second speed, the controller 22 may control the drive unit 18 to rotate the basket 3 at the second speed. After a load applied to the drive unit 18 is reduced to some degree due to a lowering of the level of water in the tub 2, the basket 3 may be rotated at a higher speed or second speed so as to create a more powerful water stream F in the lower region of the tub 2, thereby separating pollutants from the filter 14 more easily. As shown in FIG. 5(*c*), the second speed may be 150 rpm, but embodiments are not limited thereto.

The first speed may be a speed at which the basket 3 rotates while the level of water in the tub 2 is gradually lowered from the washing level H1, that is, the speed at which the basket 3 rotates when a considerable amount of water is contained in the tub 2. Accordingly, when the basket 3 rotates at the first speed, the water between the tub 2 and the drum 3*b* may be raised above the upper end of the basket 3 by a centrifugal force caused by the rotation of the basket 3, and may flow along the cover 2*a* and fall into the basket 3 again. Thus, pollutants that have not passed through the filter 14 but remain between the basket 3 and the tub 2 may be introduced into the basket 3. Accordingly, the first speed may be set within a range in which the water between the tub 2 and the basket 3 cannot be raised to the upper end of the basket when the level of water in the tub 2 is equal to or higher than the set water level H2 but equal to or lower than the washing level H1. As shown in FIG. 5(*b*), the first speed may be about 40 rpm, but embodiments are not limited thereto.

The set water level H2 may be a level determined such that the pulsator 4 may not be completely immersed in water. For example, the set water level H2 may be a level at which a lower surface of the pulsator 4 may be immersed in water but an upper surface of the pulsator 4 may not be immersed in the water. In order to clean the filter 14, the set water level H2 may be at a level at which at least a portion of the pulsator 4 may be immersed in water or at which the pulsator 4 may be completely immersed in the water.

When the level of water in the tub 2 is equal to or lower than the set water level H2, since the tub 12 and the filter 14 are also rotated with the basket 3, a rotation of the water stream may become enhanced due to friction with components, and a rotating water stream may be directed outward in the radial direction between the base 3*a* of the basket 3 and the tub 2. For example, since the water raised between the basket 3 and the tub 2 presses to an inner surface of the tub 2 due to the water stream directed outward in the radial direction, as shown in FIG. 6, a surface of the water where the water presses to the tub 2 may be separated from the drum 3*b*. To this end, the set water level H2 and the second speed should be set to appropriate values. Since the surface of water is separated from the drum 3*b* in a region at which the water is raised due to the centrifugal force, the water may not be introduced into the basket 3 through the through holes 3*c* in the drum 3*b*. Accordingly, pollutants, which have not passed through the filter 14 but remain between the basket 3 and the tub 2, may be prevented from being introduced into the basket 3 together with water. Furthermore, since a gap g (see FIG. 6) may occur between the drum 3*b* and the surface of water, the water between the drum 3*b* and the tub 2 may fall directly down and be discharged through the water discharge port 8*h* without being introduced into the basket 3 through the through holes 3*c*, even when the rotation of the basket 3 is stopped during the water discharge.

The dewatering step S14 may be a step of dewatering or removing water from laundry by rotating the basket 3 at a high speed. The basket 3 may be rotated at a higher speed than the second speed. In the dewatering step S14, the water discharge valve may be opened and the water discharge pump 9 may be operated so as to allow the water removed from the laundry to be discharged. The dewatering step S14 may include a step of increasing the rotational speed of the basket 3 rotated at the second speed to a predetermined dewatering or water removal speed. However, embodiments are not limited thereto, and the dewatering step may include a step of stopping the rotation of the basket 3 and then increasing the rotational speed of the basket 3 to the dewatering speed after completion of the water discharge step S13.

The first rinsing process S20 may include a water supply step S1, a first rinsing step S22, a water discharge step S23, and a dewatering step S24. In the water supply step S21, the water supply valve 7 may be opened so as to allow water to be supplied into the tub up to a predetermined rinsing level. Unlike the water supply step S11 in the washing process S10, detergent may not be supplied during the water supply.

The first rinsing step S22 may be a step of rotating at least one of the pulsator 4 and the basket 3 in accordance with a predetermined pattern while the tub 2 is filled with the water supplied in the water supply step S21. The rotation of the basket 3 or the pulsator 4 may create a water stream, thereby enabling the rinsing of laundry.

The water discharge step S23 and the dewatering step S24 may be substantially identical or similar to the water discharge step S13 and the dewatering step S14. However, in the water discharge step S23, the basket 3 may be rotated in a direction opposite to the rotational direction in the water discharge step S13. For example, in the water discharge step S23 of a second process S20, which may be executed after a first process S10, the basket 3 may be rotated in the direction opposite to the rotational direction of the basket 3 in the water discharge step S13 of the first process.

The second rinsing process S30, which may perform a rinsing operation, may include steps S31, S32, S33 and S34, which may be substantially identical or similar to the steps of the first rinsing process S20. However, in the water discharge step S33, the basket 3 may be rotated in the direction opposite to the rotational direction in the water discharge step S23.

Various embodiments have been described in the best mode for carrying out the disclosure. Although the preferred embodiments of the present application have been disclosed for illustrative purposes, those skilled in the art will appreciate that various modifications, additions and substitutions are possible, without departing from the scope and spirit of the invention as disclosed in the accompanying claims.

The invention claimed is:

1. A washing machine comprising:

a tub configured to contain water;

a basket provided in the tub and rotatable about a vertical axis, the basket having an opening formed in a bottom thereof to allow the basket to communicate with the tub, and a plurality of through holes formed in a side wall thereof through which water flows laterally;

a pulsator rotatably provided at a lower portion of the basket;

a filter to filter water that flows from the tub to the basket through the opening during rotation of the pulsator;

a water supply valve to supply water to the tub;

a water discharge pump to discharge water from the tub;

a drive mechanism to drive at least one of the pulsator and the basket; and a controller configured to control the water supply valve to be opened for water supply, controls the drive mechanism to rotate at least one of the pulsator and the basket so as to treat laundry introduced into the basket, controls the water discharge pump to discharge water used in the treatment of the laundry, and controls the drive mechanism to rotate the basket while the water is discharged by the water discharge pump.

2. The washing machine according to claim 1, wherein the controller controls the basket to be rotated at a first rotational speed while the water discharge is executed, and controls the basket to be increased to a second rotational speed when a level of water in the tub is lowered to a predetermined level while the basket rotates at the first rotational speed.

3. The washing machine according to claim 2, wherein the basket includes:

the side wall extending around the vertical axis; and a base, which is coupled to a lower end of the side wall so as to constitute the lower portion, with the opening formed in the center of the base, wherein the second rotational speed is set such that water is raised between the side wall and the tub and presses to the tub due to a centrifugal force caused by rotation of the basket, whereby a surface of water where the water presses to the tub is separated from the side wall of the basket.

4. The washing machine according to claim 2, wherein the first rotational speed is set such that the water raised between the side wall and the tub by rotation of the basket is not raised beyond an upper end of the basket.

5. The washing machine according to claim 2, wherein the predetermined level is set such that the pulsator is not completely immersed in the water.

6. The washing machine according to claim 5, wherein the predetermined level is set such that at least the filter is completely immersed in the water.

7. The washing machine according to claim 1, wherein the controller executes a first process including the water supply, the treatment of laundry and the water discharge, and after the first process, executes a second process including the water supply, the treatment of laundry and the water discharge, wherein the basket in the water discharge of the second process is rotated in a direction opposite to a direction in which the basket rotates in the first process.

8. The washing machine according to claim 1, wherein the tub includes a water discharge port provided under the filter.

9. The washing machine according to claim 1, further including a hub coupled to the basket and rotated by the drive mechanism, wherein the filter is provided under the hub.

10. A method of controlling a washing machine, which includes a tub to contain water, a basket provided in the tub so as to be rotatable about a vertical axis, the basket having an opening formed in a lower portion thereof so as to allow the basket to communicate with the tub, and a plurality of through holes formed in a side wall thereof through which water flows laterally, a pulsator rotatably provided at a lower portion of the basket, and a filter to filter water that flows from the tub to the basket through the opening during rotation of the pulsator and a controller configured to control the water supply valve to be opened for water supply, controls the drive mechanism to rotate at least one of the pulsator and the basket so as to treat laundry introduced into the basket, controls the water discharge pump to discharge water used in the treatment of the laundry, and controls the drive mechanism to rotate the basket while the water is discharged by the water discharge pump, the method comprising:

treating laundry by rotating the basket while the tub is filled with water; and discharging the water in the tub, wherein discharging the water in the tub includes rotating the basket during the discharge of the water in the tub.

11. The method according to claim 10, wherein rotating the basket during the discharge of the water in the tub includes:

rotating the basket at a first speed;

increasing a rotational speed of the basket from the first speed to a second speed; and rotating the basket at the second speed.

12. The method according to claim 11, further including detecting a level of water in the tub, wherein increasing the rotational speed of the basket is executed when the detected level of water is lowered to a pre-determined level.

13. The method according to claim 12, wherein the predetermined level is set such that the filter is completely immersed in water but at least a portion of the pulsator is not immersed in the water.

14. The method according to claim 11, wherein the first speed is about 40 rpm.

15. The method according to claim 11, wherein the second speed is about 150 rpm.

* * * * *